US010578354B2

(12) United States Patent
Pierre, Jr. et al.

(10) Patent No.: US 10,578,354 B2
(45) Date of Patent: Mar. 3, 2020

(54) SYSTEMS AND METHODS FOR THE PRODUCTION OF LIQUEFIED NITROGEN USING LIQUEFIED NATURAL GAS

(71) Applicants: Fritz Pierre, Jr., Humble, TX (US); Parag A. Gupte, Sugar Land, TX (US); Richard A. Huntington, Spring, TX (US)

(72) Inventors: Fritz Pierre, Jr., Humble, TX (US); Parag A. Gupte, Sugar Land, TX (US); Richard A. Huntington, Spring, TX (US)

(73) Assignee: ExxonMobil Upstream Reseach Company, Spring, TX (US)

( * ) Notice: Subject to any disclaimer, the term of this patent is extended or adjusted under 35 U.S.C. 154(b) by 676 days.

(21) Appl. No.: 15/182,023

(22) Filed: Jun. 14, 2016

(65) Prior Publication Data

US 2017/0010041 A1 Jan. 12, 2017

Related U.S. Application Data

(60) Provisional application No. 62/191,130, filed on Jul. 10, 2015.

(51) Int. Cl.
*F25J 1/00* (2006.01)
*F25J 1/02* (2006.01)

(52) U.S. Cl.
CPC ..... *F25J 1/0015* (2013.01); *F25J 1/004* (2013.01); *F25J 1/0042* (2013.01); *F25J 1/0223* (2013.01);
(Continued)

(58) Field of Classification Search
CPC ..... F25J 1/0015; F25J 1/004; F25J 1/0042; F25J 1/0223; F25J 1/0224; F25J 1/0264; F25J 2210/06; F25J 2210/62; F25J 2230/08; F25J 2230/30; F25J 2230/60; F25J 2235/60; F25J 2240/40
(Continued)

(56) References Cited

U.S. PATENT DOCUMENTS 3,180,709 A 4/1965 Yendall et al. ..... 23/210
3,347,055 A 10/1967 Blanchard et al. ..... 62/9
(Continued)

FOREIGN PATENT DOCUMENTS

CN 102628635 10/2014 ..... F25J 3/08
DE 1960515 5/1971 ..... F25J 1/02
(Continued)

OTHER PUBLICATIONS

U.S. Appl. No. 15/347,968, filed Nov. 10, 2016, Pierre, Fritz Jr. et al.
(Continued)

*Primary Examiner* — Edward F Landrum
*Assistant Examiner* — Chang H Park
(74) *Attorney, Agent, or Firm* — ExxonMobil Upstream Reseach Company—Law Department

(57) ABSTRACT

Described herein are systems and processes to produce liquefied nitrogen (LIN) using liquefied natural gas (LNG) as the refrigerant. The LIN may be produced by indirect heat exchange of at least one nitrogen gas stream with at least two LNG streams within at least one heat exchanger where the LNG streams are at different pressures.

10 Claims, 4 Drawing Sheets

(52) U.S. Cl.
CPC ..... *F25J 1/0224* (2013.01); *F25J 1/0264* (2013.01); *F25J 2210/06* (2013.01); *F25J 2210/62* (2013.01); *F25J 2230/08* (2013.01); *F25J 2230/30* (2013.01); *F25J 2230/60* (2013.01); *F25J 2235/60* (2013.01); *F25J 2240/40* (2013.01)

(58) Field of Classification Search
USPC ..... 62/612, 613, 614, 912
See application file for complete search history.

(56) References Cited

U.S. PATENT DOCUMENTS

| | | | | |
|---|---|---|---|---|
| 3,370,435 | A | 2/1968 | Arregger | 62/28 |
| 3,400,547 | A * | 9/1968 | Williams | B63B 25/08 62/50.1 |
| 3,677,019 | A * | 7/1972 | Olszewski | F25J 1/0015 62/613 |
| 3,724,226 | A | 4/1973 | Pachaly | 62/39 |
| 3,878,689 | A | 4/1975 | Grenci | 62/9 |
| 4,415,345 | A | 11/1983 | Swallow | 62/28 |
| 5,025,860 | A | 6/1991 | Mandrin | 166/267 |
| 5,137,558 | A | 8/1992 | Agrawal | 62/24 |
| 5,139,547 | A * | 8/1992 | Agrawal | F17C 9/04 62/616 |
| 5,141,543 | A | 8/1992 | Agrawal et al. | 62/8 |
| 5,638,698 | A | 6/1997 | Knight et al. | 62/632 |
| 5,768,912 | A * | 6/1998 | Dubar | F25J 1/0022 62/613 |
| 5,950,453 | A | 9/1999 | Bowen et al. | 62/612 |
| 6,003,603 | A | 12/1999 | Breivik et al. | 166/357 |
| 6,295,837 | B1 * | 10/2001 | Den | F25J 3/04054 62/434 |
| 6,295,838 | B1 | 10/2001 | Shah et al. | 62/643 |
| 6,298,688 | B1 | 10/2001 | Brostow et al. | 62/613 |
| 6,412,302 | B1 | 7/2002 | Foglietta | 62/611 |
| 6,662,589 | B1 | 12/2003 | Roberts et al. | 62/425 |
| 6,889,522 | B2 | 5/2005 | Prible | 62/612 |
| 7,143,606 | B2 | 12/2006 | Tranier | 62/611 |
| 7,278,281 | B2 | 10/2007 | Yang et al. | 62/612 |
| 7,386,996 | B2 | 6/2008 | Fredheim et al. | 62/612 |
| 7,520,143 | B2 | 4/2009 | Spilsbuty | 62/620 |
| 8,079,321 | B2 | 12/2011 | Balasubramanian | 114/74 |
| 8,435,403 | B2 | 5/2013 | Sapper et al. | 208/254 |
| 8,464,289 | B2 | 6/2013 | Pan | 725/34 |
| 8,601,833 | B2 | 12/2013 | Dee et al. | 62/648 |
| 8,616,012 | B2 | 12/2013 | Duerr et al. | 62/89 |
| 8,646,289 | B1 | 2/2014 | Shivers, III et al. | 62/611 |
| 9,163,873 | B2 * | 10/2015 | Jakobsen | F25J 1/0022 |
| 9,422,037 | B2 | 8/2016 | VanWijngaarden et al. | 114/74 |
| 9,435,229 | B2 | 9/2016 | Alekseev et al. | 60/643 |
| 2006/0000615 | A1 | 1/2006 | Choi | 166/352 |
| 2008/0000266 | A1 | 1/2008 | Dee et al. | 62/643 |
| 2009/0217701 | A1 | 9/2009 | Minta et al. | 62/612 |
| 2010/0192626 | A1 | 8/2010 | Chantant | 62/606 |
| 2010/0251763 | A1 | 10/2010 | Audun | 62/614 |
| 2010/0319361 | A1 | 12/2010 | Chantant et al. | 62/50.2 |
| 2011/0036121 | A1 | 2/2011 | Roberts et al. | 62/612 |
| 2011/0126451 | A1 | 6/2011 | Pan et al. | 44/451 |
| 2011/0259044 | A1 | 10/2011 | Baudat et al. | 62/611 |
| 2012/0103010 | A1 | 5/2012 | Butts | 62/613 |
| 2012/0285196 | A1 | 11/2012 | Flinn et al. | 62/620 |
| 2013/0199238 | A1 | 8/2013 | Mock et al. | 62/611 |
| 2014/0130542 | A1 | 5/2014 | Brown et al. | 62/612 |
| 2017/0016667 | A1 | 1/2017 | Huntington et al. | 62/614 |
| 2017/0016668 | A1 | 1/2017 | Pierre, Jr. et al. | 62/614 |

FOREIGN PATENT DOCUMENTS

| | | | |
|---|---|---|---|
| DE | 2354726 | 5/1975 | F17C 9/04 |
| DE | 102013007208 | 10/2014 | B01D 3/14 |
| EP | 1972875 | 9/2008 | F25J 3/04 |
| FR | 2756368 | 5/1998 | B01D 53/26 |
| GB | 1376678 | 12/1974 | F25J 1/02 |
| GB | 1596330 | 8/1981 | F25J 1/02 |
| GB | 2172388 | 9/1986 | E21B 43/16 |
| GB | 2333148 | 7/1999 | F25J 1/02 |
| GB | 2470062 | 11/2010 | F25J 1/02 |
| GB | 2486036 | 11/2012 | F25J 1/02 |
| JP | S59216785 | 12/1984 | F17C 13/00 |
| WO | WO2006/120127 | 11/2006 | F25J 3/02 |
| WO | WO2014/078092 | 5/2014 | C10L 3/10 |
| WO | WO2015/110443 | 7/2015 | F25J 1/00 |

OTHER PUBLICATIONS

U.S. Appl. No. 15/347,983, filed Nov. 10, 2016, Pierre, Fritz Jr. et al.
U.S. Appl. No. 15/348,004, filed Nov. 10, 2016, Pierre, Fritz Jr. et al.
U.S. Appl. No. 15/348,533, filed Nov. 10, 2016, Pierre, Fritz Jr.
U.S. Appl. No. 62/458,127, filed Feb. 13, 2017, Pierre, Fritz Jr.
U.S. Appl. No. 62/458,131, filed Feb. 13, 2017, Pierre, Fritz Jr.
U.S. Appl. No. 62/463,274, filed Feb. 24, 2017, Kaminsky, Robert D. et al.
U.S. Appl. No. 62/478,961, Balasubramanian, Sathish.
Publication No. 43031 (2000) Research Disclosure, Mason Publications, Hampshire, GB, Feb. 1, 2000, p. 239, XP000969014, ISSN: 0374-4353, paragraphs [0004], [0005] & [0006].
Publication No. 37752 (1995) Research Disclosure, Mason Publications, Hampshire, GB, Sep. 1, 1995, p. 632, XP000536225, ISSN: 0374-4353, 1 page.
Bach, Wilfried (1990) "Offshore Natural Gas Liquefaction with Nitrogen Cooling—Process Design and Comparison of Coil-Wound and Plate-Fin Heat Exchangers," *Science and Technology Reports*, No. 64, Jan. 1, 1990, pp. 31-37.

* cited by examiner

SYSTEMS AND METHODS FOR THE PRODUCTION OF LIQUEFIED NITROGEN USING LIQUEFIED NATURAL GAS

CROSS REFERENCE TO RELATED APPLICATIONS

This application claims the priority benefit of U.S. Patent Application 62/191,130 filed Jul. 10, 2015 entitled SYSTEM AND METHODS FOR THE PRODUCTION OF LIQUEFIED NITROGEN GAS USING LIQUEFIED NATURAL GAS, the entirety of which is incorporated by reference herein.

BACKGROUND OF THE INVENTION

Liquefied natural gas ("LNG") has allowed the supply of natural gas from locations with an abundant supply of natural gas to distant locations with a strong demand for natural gas. The conventional LNG cycle includes: (a) initial treatment of the natural gas resource to remove contaminants such as water, sulfur compounds, and carbon dioxide; (b) separation of some heavier hydrocarbon gases, such as propane, butane, and pentane, from the natural gas, where the separation can occur by a variety of possible methods including self-refrigeration, external refrigeration, or lean oil, etc.; (c) refrigeration of the natural gas to form liquefied natural gas at near atmospheric pressure and about −160° C.; (d) transport of the LNG product in ships or tankers to a market location; and (e) re-pressurization and re-gasification of the LNG at a regasification plant to a pressure at which natural gas may be distributed to natural gas customers. Step (c) of the conventional LNG cycle typically uses external refrigeration which requires the use of large refrigeration compressors often powered by large gas turbine drivers that can produce greenhouse gas emissions. Thus, a large capital investment is typically needed to put in place the extensive infrastructure needed for the liquefaction plant. Step (e) of the LNG cycle generally includes re-pressurizing the LNG to the required pressure using cryogenic pumps and then re-gasifying the LNG to pressurized natural gas by exchanging heat through an intermediate fluid, such as seawater, or by combusting a portion of the natural gas to vaporize the LNG.

A cold refrigerant produced at a different location, such as liquefied nitrogen gas ("LIN"), can be used to liquefy natural gas. For example, U.S. Pat. No. 3,400,547 describes shipping liquid nitrogen or liquid air from a market place to a field site where it is used to liquefy natural gas. The LNG is shipped back to the market site in the tanks of the same cryogenic carrier used to transport the liquefied nitrogen or air to the field site. Regasification of the LNG is carried out at the market site, where the excess cold from the regasification process is used to liquefy nitrogen or air for shipping to the field site.

However, since the natural gas from the regasification of LNG must be at a higher pressures (e.g., greater than 800 psi) for introduction into the gas sales pipeline, the total energy needed for both the production of LIN and the re-pressurization of natural gas can be significantly greater than the energy needed to produce LNG using conventional processes. Therefore, there is a need to develop more energy efficient methods to produce LIN and high pressure natural gas from the regasification of LNG.

Furthermore, the process of U.S. Pat. No. 3,400,547 requires the integration of the complete LNG value chain. That is, there must be integration of the production of LNG using LIN as the cold refrigerant, the shipping of LIN to the natural gas resource location, the shipping of LNG to regasification locations, and the production of LIN using the available exergy from the regasification of LNG. This value chain is further described in U.S. Patent Application Publication Nos. 2010/0319361 and 2010/0251763.

The production of LNG at the gas resource site using LIN as the sole refrigerant may require a LIN to LNG ratio of greater than 1:1. For this reason, the production of LIN at the regasification site favors a greater than 1:1 LIN to LNG ratio in order to ensure that only the LNG produced using the LIN is then required to liquefy the needed amount of nitrogen. The matching of the LIN to LNG ratio at both the LNG plant and the regasification plant allows for an easier integration of the LNG value chain since LNG from additional production sources is not needed.

GB Patent Application Publication No. 2,333,148 describes a process where the vaporization of LNG is used to produce LIN, where the LIN to LNG ratio that is used is greater than 1.2:1. In GB Publication No. 2,333,148 the LNG is vaporized close to atmospheric pressure. Therefore, since the standardized pressure at which LNG must be when entering the gas sales pipeline is greater than 800 psi, a significant amount of energy is required to compress the natural gas to pipeline pressure. As such, there is a need for a method which allows pumping the LNG to higher pressures prior to vaporization in order to minimize the required amount of natural gas compression.

GB Patent 1,376,678 and U.S. Pat. Nos. 5,139,547 and 5,141,543 describe methods where LNG is first pressurized to the pipeline transport pressure prior to vaporization of the LNG. In these disclosures, the vaporizing LNG is used to condense the nitrogen gas and is used as the interstage coolant for the multistage compression of the nitrogen gas to a pressure of at least 350 psi. The interstage cooling of the nitrogen gas using the vaporizing and warming of the natural gas allows for cold compression of the nitrogen gas which significantly reduces its energy of compression. However, in these disclosures a LIN to LNG ratio of less than 0.5:1 is used to produce the LIN and high pressure natural gas. This low LIN to LNG ratio does not allow for point-to-point integration of the regasification plant with the LNG plant, since a LIN to LNG ratio of at least 1:1 is typically required to produce LNG using LIN as the sole refrigerant.

U.S. Patent Application Publication No. 2010/0319361 describes a method where LNG from multiple production sources are used to produce the LIN needed for LNG production at one production site. However, this multi-source LNG value chain arrangement significantly complicates the LNG value chain.

Therefore, there remains a need to develop an energy efficient method for producing LIN and high pressure natural gas from the regasification of LNG. There is further a need for an integrated method that is able to utilize a LIN to LNG ratio that is greater than 1:1, or more preferably greater than 1.2:1.

Other background references include GB Patent No. 1596330, GB Patent No. 2172388, U.S. Pat. Nos. 3,878,689, 5,950,453, 7,143,606, and PCT Publication No. WO 2014/078092.

SUMMARY OF THE INVENTION

Figure 1:
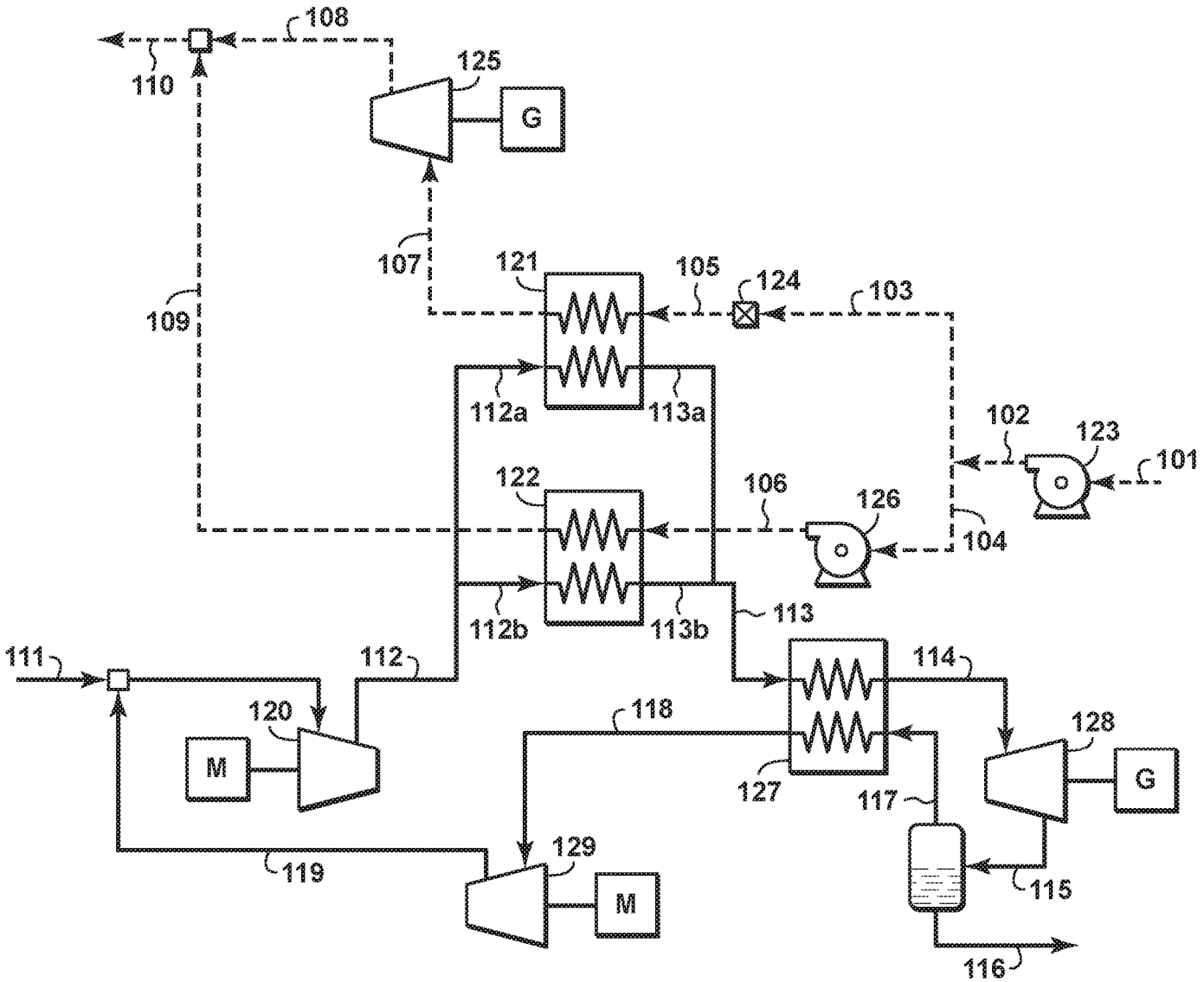
FIG. 1 illustrates a system where LIN and pressurized natural gas for pipeline transport are produced by indirect heat exchange of at least one nitrogen gas stream with two or more LNG streams in at least two heat exchangers where each of the LNG streams is at a different pressure.

Provided herein are methods for producing a liquefied gas stream, such as a liquefied nitrogen stream. For example, the method may comprise a method for producing a liquefied nitrogen gas (LIN) stream at a liquid natural gas (LNG) regasification facility comprising. In some embodiments, the method may comprise (a) providing a nitrogen gas stream; (b) providing at least two LNG streams where the pressures of each LNG stream are independent and different from each other; (c) liquefying the nitrogen gas stream by indirect heat exchange of the nitrogen gas stream with the LNG streams in at least one heat exchanger; (d) vaporizing at least a portion of the two LNG streams to produce at least two natural gas streams; and (e) compressing at least one of the two natural gas streams to form compressed natural gas.

DETAILED DESCRIPTION OF THE INVENTION

Various specific embodiments and versions of the present invention will now be described, including preferred embodiments and definitions that are adopted herein. While the following detailed description gives specific preferred embodiments, those skilled in the art will appreciate that these embodiments are exemplary only, and that the present invention can be practiced in other ways. Any reference to the "invention" may refer to one or more, but not necessarily all, of the embodiments defined by the claims. The use of headings is for purposes of convenience only and does not limit the scope of the present invention.

All numerical values within the detailed description and the claims herein are modified by "about" or "approximately" the indicated value, and take into account experimental error and variations that would be expected by a person having ordinary skill in the art.

As used herein, "auto-refrigeration" refers to a process whereby a fluid is cooled via a reduction in pressure. In the case of liquids, auto-refrigeration refers to the cooling of the liquid by evaporation, which corresponds to a reduction in pressure. More specifically, a portion of the liquid is flashed into vapor as it undergoes a reduction in pressure while passing through a throttling device. As a result, both the vapor and the residual liquid are cooled to the saturation temperature of the liquid at the reduced pressure. For example, auto-refrigeration of a natural gas may be performed by maintaining the natural gas at its boiling point so that the natural gas is cooled as heat is lost during boil off. This process may also be referred to as a "flash evaporation."

As used herein, the term "compressor" means a machine that increases the pressure of a gas by the application of work. A "compressor" or "refrigerant compressor" includes any unit, device, or apparatus able to increase the pressure of a gas stream. This includes compressors having a single compression process or step, or compressors having multi-stage compressions or steps, or more particularly multi-stage compressors within a single casing or shell. Evaporated streams to be compressed can be provided to a compressor at different pressures. Some stages or steps of a cooling process may involve two or more compressors in parallel, series, or both. The present invention is not limited by the type or arrangement or layout of the compressor or compressors, particularly in any refrigerant circuit.

As used herein, "cooling" broadly refers to lowering and/or dropping a temperature and/or internal energy of a substance, such as by any suitable amount. Cooling may include a temperature drop of at least about 1° C., at least about 5° C., at least about 10° C., at least about 15° C., at least about 25° C., at least about 35° C., or least about 50° C., or at least about 75° C., or at least about 85° C., or at least about 95° C., or at least about 100° C. The cooling may use any suitable heat sink, such as steam generation, hot water heating, cooling water, air, refrigerant, other process streams (integration), and combinations thereof. One or more sources of cooling may be combined and/or cascaded to reach a desired outlet temperature. The cooling step may use a cooling unit with any suitable device and/or equipment. According to some embodiments, cooling may include indirect heat exchange, such as with one or more heat exchangers. In the alternative, the cooling may use evaporative (heat of vaporization) cooling and/or direct heat exchange, such as a liquid sprayed directly into a process stream.

As used herein, the term "expansion device" refers to one or more devices suitable for reducing the pressure of a fluid in a line (for example, a liquid stream, a vapor stream, or a multiphase stream containing both liquid and vapor). Unless a particular type of expansion device is specifically stated, the expansion device may be (1) at least partially by isenthalpic means, or (2) may be at least partially by isentropic means, or (3) may be a combination of both isentropic means and isenthalpic means. Suitable devices for isenthalpic expansion of natural gas are known in the art and generally include, but are not limited to, manually or automatically, actuated throttling devices such as, for example, valves, control valves, Joule-Thomson (J-T) valves, or venturi devices. Suitable devices for isentropic expansion of natural gas are known in the art and generally include equipment such as expanders or turbo expanders that extract or derive work from such expansion. Suitable devices for isentropic expansion of liquid streams are known in the art and generally include equipment such as expanders, hydraulic expanders, liquid turbines, or turbo expanders that extract or derive work from such expansion. An example of a combination of both isentropic means and isenthalpic means may be a Joule-Thomson valve and a turbo expander in parallel, which provides the capability of using either alone or using both the J-T valve and the turbo expander simultaneously. Isenthalpic or isentropic expansion can be conducted in the all-liquid phase, all-vapor phase, or mixed phases, and can be conducted to facilitate a phase change from a vapor stream or liquid stream to a multiphase stream (a stream having both vapor and liquid phases) or to a single-phase stream different from its initial phase. In the description of the drawings herein, the reference to more than one expansion device in any drawing does not necessarily mean that each expansion device is the same type or size.

The term "gas" is used interchangeably with "vapor," and is defined as a substance or mixture of substances in the gaseous state as distinguished from the liquid or solid state. Likewise, the term "liquid" means a substance or mixture of substances in the liquid state as distinguished from the gas or solid state.

A "heat exchanger" broadly means any device capable of transferring heat energy or cold energy from one media to another media, such as between at least two distinct fluids. Heat exchangers include "direct heat exchangers" and "indirect heat exchangers." Thus, a heat exchanger may be of any suitable design, such as a co-current or counter-current heat exchanger, an indirect heat exchanger (e.g. a spiral wound heat exchanger or a plate-fin heat exchanger such as a brazed aluminum plate fin type), direct contact heat exchanger, shell-and-tube heat exchanger, spiral, hairpin, core, core-and-kettle, double-pipe or any other type of known heat exchanger. "Heat exchanger" may also refer to any column, tower, unit or other arrangement adapted to allow the passage of one or more streams there through, and to affect direct or indirect heat exchange between one or more lines of refrigerant, and one or more feed streams.

As used herein, the term "indirect heat exchange" means the bringing of two fluids into heat exchange relation without any physical contact or intermixing of the fluids with each other. Core-in-kettle heat exchangers and brazed aluminum plate-fin heat exchangers are examples of equipment that facilitate indirect heat exchange.

As used herein, the term "natural gas" refers to a multi-component gas obtained from a crude oil well (associated gas) or from a subterranean gas-bearing formation (non-associated gas). The composition and pressure of natural gas can vary significantly. A typical natural gas stream contains methane ($C_1$) as a significant component. The natural gas stream may also contain ethane ($C_2$), higher molecular weight hydrocarbons, and one or more acid gases. The natural gas may also contain minor amounts of contaminants such as water, nitrogen, iron sulfide, wax, and crude oil.

Described herein are systems and processes where LIN and natural gas that is at sufficiently high pressure such that it is suitable for pipeline transport (e.g., 800 psia or greater) are produced by indirect heat exchange of at least one nitrogen gas stream with at least two LNG streams within at least one heat exchanger where the LNG streams are at different pressures. In some embodiments, the LIN and high pressure natural gas are produced by the indirect heat exchange of at least one nitrogen gas stream with at least three, or at least four, LNG streams in a multi-stream heat exchanger where each of the LNG streams are at a different pressure from the other LNG streams.

For example, a single LNG stream may be pressurized, for example by using one or more pumps, to an intermediate pressure. The intermediate pressure LNG stream is then split into at least two LNG streams. At least one of the LNG streams is let down in pressure, for example using one or more expansion devices, such as valves, hydraulic turbines, or other devices as known in the art. The reduced pressure LNG stream(s) are then conveyed to at least one heat exchanger. At least one of the LNG streams that is at the intermediate pressure is additionally pressurized using one or more pumps to a pressure higher than the intermediate pressure, such as a pressure equal to or higher than the natural gas sales pipeline pressure. The additionally pressurized LNG stream(s) are then piped to the at least one heat exchanger. The at least two LNG streams undergo indirect heat exchange with at least one nitrogen gas stream within the at least one heat exchanger, whereby the nitrogen gas stream is liquefied forming LIN.

In a preferred embodiment, a single LNG stream is introduced to the system. In some embodiments, the LNG stream that enters the system is at a pressure of greater than 14 psia, or greater than 15 psia. The LNG stream that enters the system may be at a pressure of less than 65 psia, or less than 55 psia, or less than 45 psia, or less than 35 psia, or less than 25 psia, or less than 20 psia. For example, in some embodiments, the LNG stream that enters the system may be at a pressure of from about 14 to about 25 psia, or from about 15 to 25 psia, or at a pressure typical for the transport of LNG, such as about 17 psia.

The LNG stream is then pressurized using one or more pumps to an intermediate pressure. The intermediate pressure may be a pressure greater than 50 psia, or greater than 60 psia, or greater than 70 psia, or greater than 75 psia. The intermediate pressure may be less than 250 psia, or less than 200 psia, or less than 175 psia, or less than 150 psia. In some embodiments, the intermediate pressurized LNG stream may be a pressure from 50 to 200 psia, or from 70 to 150 psia, or from 75 to 100 psia.

The pressurized LNG stream is then split into two or more streams. For example, the pressurized LNG stream may be split into three or four LNG streams. All but one of the pressurized LNG streams are then reduced in pressure using one or more expansion devices, such as valves, hydraulic turbines, or a combination of devices, where each of the reduced pressures is different from the other reduced pressures. Thus, in an embodiment where the pressurized LNG stream was split into three LNG streams, two of the LNG streams are reduced to different pressures using one or more valves and one LNG stream is not reduced in pressure or is kept at the intermediate pressure. Likewise, in an embodiment where the pressurized LNG stream was split into four LNG streams, three of the LNG streams would be reduced in pressure to different pressures using one or more valves and one LNG stream is not reduced in pressure or is kept at the intermediate pressure. The LNG stream that is not reduced in pressure may remain at the intermediate pressure, or may be pressurized using one or more pumps to a pressure equal to or higher than the natural gas sales pipeline pressure, such as greater than 800 psia, or greater than 1200 psia.

In an embodiment, where the pressurized LNG stream was split into at least four streams, the pressures of each stream are different from one another. For example, the pressure of the first LNG stream may be reduced to a value from 10 psia to 35 pisa, or from 15 psia to 30 psia, or from 20 pisa to 25 psia. The pressure of the second LNG stream may be between 30 to 60 psia, or from 35 to 55 psia, or from 40 to 50 psia. The pressure of the third LNG stream may be between 50 psia and the intermediate pressure, or from 50 to 100 psia, or from 60 to 90 psia, or from 65 to 80 psia. The fourth LNG stream may remain at the intermediate pressure or may be pressurized using one or more pumps to a pressure equal to or higher than the natural gas sales pipeline pressure, such as greater than 800 psia, or greater than 900 psia, or greater than 1000 psia, or greater than 1100 psia, or greater than 1200 psia.

The reduced pressure LNG streams and the additionally pressurized LNG stream are all piped to at least one heat exchanger, and in preferred embodiments, are piped to a single multi-stream cryogenic heat exchanger. The LNG streams undergo indirect heat exchange with a nitrogen gas stream that is also piped to the heat exchanger. Suitable heat exchangers include, but are not limited to, cryogenic heat exchangers, which may include brazed aluminum type heat exchangers, spiral wound type heat exchanger, and printed circuit type heat exchangers.

As it is known in the art, a suitable heat exchanger will allow for indirect heat exchange between the LNG streams and the nitrogen gas stream while preventing or minimizing indirect heat exchange between the LNG streams. The nitrogen gas stream is at least partially liquefied within the heat exchange such that less than 20 mol %, or less than 15 mol %, or less than 10 mol %, or less than 7 mol %, or less than 5 mol %, or less than 3 mol %, or less than 2 mol %, or less than 1 mol % of the stream remains in the vapor phase.

The pressure of the nitrogen gas stream that is piped to the heat exchanger may be greater than 200 psia, or greater than the critical point pressure of the nitrogen gas stream, or greater than 700 psia, or greater than 800 psia, or greater than 900 psia, or greater than 1000 psia, or greater than 1100 psia, or greater than 1200 psia.

The composition of the nitrogen gas stream may be at least 70% nitrogen, or at least 75% nitrogen, or at least 80% nitrogen, or at least 85% nitrogen, or at least 90% nitrogen, or at least 95% nitrogen. The nitrogen gas stream may comprise other gaseous impurities, such as other components found in air, such as oxygen, argon and carbon dioxide.

The pressures, flow rates and heat exchanger outlet temperatures of the LNG streams entering the multi-stream heat exchanger may be chosen to allow for close matching of the nitrogen gas stream's cooling curve with the warming curves or the composite warming curve of the LNG streams. In some embodiments, it is preferred that the heat exchanger outlet temperatures of the additionally pressurized LNG stream be greater than −150° C., or greater than −140° C., or greater than −130° C., or greater than −120° C., or greater than −115° C., or greater than −110° C., or greater than −105° C., or greater than −100° C., or greater than −75° C., or greater than −50° C., or greater than 0° C., or greater than 20° C. In some embodiments, the heat exchanger outlet temperature of the additionally pressurized LNG stream may be from −150° C. to 20° C., or from −140° C. to 0° C., or from −130° C. to −50° C., or from −120° C. to −75° C. The additionally pressurized LNG streams once vaporized may be at a sufficient pressure to enter the gas sale pipeline or be utilized within the regasification plant without requiring additional compression. It is preferred that heat exchanger outlet temperatures of the reduced pressure LNG streams be less than −50° C., or less than −75° C., or less than −100° C., or less than −105° C., or less than −110° C., or less than −115° C. In some embodiments, the heat exchanger outlet temperature of the reduced pressure LNG streams is from −50° C. to −150° C., or from −75° C. to −125° C., or from −80° C. to −100° C. The reduced pressure LNG streams may be fully or partially vaporized within the at least one heat exchanger.

After exiting the at least one heat exchanger, the reduced pressure LNG streams may be separated into their liquid and gas components. The liquid component of the reduced pressure LNG streams may be pumped to pressure greater than or equal to the pressure of the additionally pressurized LNG streams and then recycled back to the at least one heat exchanger. The gas component of the reduced pressure LNG streams may be pressurized in compressors to pressures suitable to introduce the compressed gases to the sale gas pipeline or to pressures suitable for use of the compressed gases within the regasification plant. It is often preferred that compressed gases be mixed with some or all the of the vaporized additionally pressurized LNG streams prior to distributing the gases. In a preferred embodiment, the heat exchanger outlet temperature of the reduced pressure LNG streams are sufficiently low to allow for cold compression of the gases to pressures suitable for use without requiring any intercooling of the gases during compression.

In some embodiments, all or a portion of the additionally pressurized LNG streams, after flowing through the at least one heat exchanger, may be piped to at least one second heat exchanger. Alternatively, all or a portion of the additionally pressurized LNG streams may bypass the at least one heat exchanger and may be piped directly to the at least one second heat exchanger. The at least one second heat exchanger can be used for indirect heat exchange of the additionally pressurized LNG streams with the at least one nitrogen gas stream prior to compression of the nitrogen gas stream. The cooling of the at least one nitrogen gas stream with the additionally pressurized LNG streams may occur before one or more of the compression stages of the at least one nitrogen gas stream. The cooling of the at least one nitrogen gas stream with the additionally pressurized LNG streams may occur after intercooling and/or aftercooling of the nitrogen gas stream. As it is known in the art, intercooling and aftercooling of gases may involve the removal of heat from gases after compression by indirect heat exchange with the environment. It is common for the heat to be removed using air or water from the environment. The cooling of the at least one nitrogen gas stream with all or a portion of the additionally pressurized LNG streams prior to compression of the at least one nitrogen gas stream may allow for compression of the at least one nitrogen gas at suction temperatures less than 0° C., or less than −10° C., or less than −20° C., or less than −30° C., or less than −40° C., or less than −50° C. The cold compression of the at least one nitrogen gas stream significantly reduces the energy of compression of said gas.

The process described herein has the advantage of liquefying an at least one nitrogen gas stream into an at least one LIN stream by utilizing at least two LNG streams where the required compression of the vaporized LNG streams may be significantly less than prior art. For example, GB Patent Application 2,333,148 discloses a process where the vaporization of LNG is used to produce LIN. The method of GB Patent Application 2,333,148 has the advantage that a LIN to LNG ratio of greater than 1.2:1 is used to produce the LIN. However, GB Patent Application 2,333,148 has the disadvantage that the single LNG stream is vaporized close to atmospheric pressure. Since natural gas must be admitted to the gas sales pipeline at a high pressure (greater than 800 psi), a significant amount of compression is required to pressurize the natural gas to the pipeline pressure. The compression of the close to atmospheric pressure natural gas stream would mostly likely involve the use of multiple compression stages with a significant amount of intercooling and aftercooling of the natural gas stream occurring after each compression stage. The compression of this natural gas stream would require a significant amount of capital investment in compressors and coolers within the regasification plant. It would also be an energy intensive process that would most likely eliminate any thermodynamic advantage in utilizing the available exergy in regasifying the LNG to produce the LIN. In contrast to GB Patent Application Publication No. 2,333,148, the system and method described herein only requires compression of a fraction of the total LNG flow. In some embodiments of this invention, the reduced pressure LNG streams account for no more than 20% of the total LNG flow, or less than 15% of the total LNG flow, or less than 10% of the total LNG flow. Another advantage of the present system and method is that the compression of the reduced pressure LNG stream gases may occur at temperatures less than −50° C. The cold compression of the reduced pressure LNG stream gases significantly reduces the amount of energy needed for compressing the gases.

For example, in embodiments where the LNG stream is split into four streams, the three reduced pressure streams may account for less than 20%, or less than 17%, or less than 15%, or less than 12%, or less than 10%, of the total LNG flow. In some embodiments, the lowest pressure LNG stream may account for less than 5%, or less than 4%, or less than 3%, or less than 2%, or less than 1% of the total LNG flow. In some embodiments, the second lowest pressure LNG stream may account for less than 7%, or less than 6%, or less than 5%, or less than 4%, or less than 3%, or less than 2%, of the total LNG flow. In some embodiments, the third lowest pressure LNG stream may account for less than 10%, or less than 9%, or less than 8%, or less than 7%, or less than 6%, of the total LNG flow. In some embodiments, the highest pressure LNG stream may account for greater than 80%, or greater than 82%, or greater than 84%, or greater than 86%, or greater than 88%, or greater than 90%, of the total LNG flow.

This present system and method also has the additional advantage of liquefying an at least one nitrogen gas stream to form at least one LIN stream by utilizing an at least two LNG streams where the total LIN to LNG ratio is greater than 1:1. For example, GB Patent 1,376,678 and U.S. Pat. Nos. 5,139,547 and 5,141,543 disclose methods where the LNG is first pressurized to the pipeline transport pressure prior to vaporization of the LNG. In these references, the vaporizing LNG is used to condense the nitrogen gas and used as the coolant within the intercoolers between the multistage compression of the of the nitrogen gas to a pressure at least greater than 350 psi. The intercooling of the nitrogen gas using the vaporizing and warming natural gas allows for cold compression of the nitrogen gas which significantly reduces its energy of compression. The methods and processes described in all three of these references have the disadvantage that a LIN to LNG ratio of less 0.5:1 is used to produce the LIN and high pressure natural gas. This low LIN to LNG ratio does not allow for point-to-point integration of the regasification plant with a LNG plant since a LIN to LNG ratio of 1:1 or greater is typically required to produce LNG using LIN as the sole refrigerant. In the regasification plants described in GB Patent 1,376,678 and U.S. Pat. Nos. 5,139,547 and 5,141,543, LNG sourced from conventional LNG plants would need to be used in addition to the LNG produced from the LIN. In contrast, the system and method described herein, has the advantage that it allows for the energy efficient production of LIN using a LIN to LNG ratio of greater than 1:1. The matching of the LIN to LNG ratio at both the LNG plant and the regasification plant allows for an easier integration of the LNG value chain since LNG from conventional production sources is not needed. Additionally, certain embodiments of this system and method allow for one or more of the vaporizing LNG streams to be used to cool the nitrogen gas stream prior to compression of the nitrogen gas stream in order to improve process efficiency.

Having described various aspects of the systems and methods herein, further specific embodiments of the invention include those set forth in the following paragraphs as described with reference to the Figures. While some features are described with particular reference to only one Figure (such as FIG. 1, 2, or 3), they may be equally applicable to the other Figures and may be used in combination with the other Figures or the foregoing discussion.

FIG. 1 illustrates a system where LIN and pressurized natural gas for pipeline transport are produced by indirect heat exchange of at least one nitrogen gas stream with two or more LNG streams in at least one heat exchanger where each of the LNG streams is at a different pressure. A nitrogen gas stream 111 is provided to the system. The nitrogen gas stream 111 comprises nitrogen gas and may contain less than 1000 ppm impurities, such as oxygen, or less than 750 ppm, or less than 500 ppm, or less than 250 ppm, or less than 200 ppm, or less than 150 ppm, or less than 100 ppm, or less than 75 ppm, or less than 50 ppm, or less than 25 ppm, or less than 20 ppm, or less than 15 ppm, or less than 10 ppm, or less than 5 ppm impurities. The nitrogen gas stream 111 may be provided from any available source, for example, it may be provided from commonly known industrial processes for separating nitrogen gas from air such as membrane separation, pressure swing adsorption separation, or cryogenic air separation. In some preferred embodiments, the nitrogen gas stream 111 is provided from a cryogenic air separation system. Such systems may be preferred as they can provide high purity nitrogen gas streams (e.g., less than 10 ppm impurities, such as $O_2$) at high quantities (e.g., greater than 100 MSCFD). The nitrogen gas stream 111 may be provided to the system at a pressure that is greater than atmospheric pressure, or greater than 25 psia, or greater than 50 psia, or greater than 75 psia, or greater than 100 psia, or greater than 125 psia, or greater than 150 psia, or greater than 200 psia.

The nitrogen gas stream 111 may be conveyed or transported, for example be piped, to a compressor 120. The compressor 120 increases the pressure of the nitrogen gas streams to a pressures greater than 200 psia, or greater than 300 psia, or greater than 400 psia, or greater than 500 psia, or greater than 600 psia, or greater than 700 psia, or greater than 800 psia, or greater than 900 psia, or greater than 1000 psi. In some embodiments, the compressor 120 increases the pressure of the nitrogen gas stream to a pressure greater than the critical point pressure of the nitrogen gas stream. The compression of the nitrogen gas stream may occur in a single stage or in multiple stages of compression. In some embodiments, more than one compressor may be used, where the compressors are parallel, in series, or both. The high pressure nitrogen gas stream 112 may then be split into two streams 112*a* and 112*b* which are then piped to heat exchangers 121 and 122 where they are liquefied by heat exchange with vaporizing LNG streams to form high pressure LIN stream 113.

With reference to FIG. 1, a LNG stream 101 is introduced to the system and is pressurized to an intermediate pressure to form intermediate pressure LNG stream 102. The LNG stream 101 may be pressurized utilizing means known in the art, for example a pump 123. The intermediate pressure LNG stream 102 is split into at least two LNG streams, a first LNG stream 103 and a second LNG stream 104. The first LNG stream 103 may be reduced in pressure by flowing through one or more valves 124 to form a reduced pressure LNG stream 105. The pressure of the reduced pressure LNG stream 105 may be less than less than 800 psia, or less than 700 psia, or less than 600 psia, or less than 500 psia, or less than 400 psia, or 300 psia, or less than 250 psia, or less than 200 psia, or less than 175 psia, or less than 150 psia. The pressure of the reduced LNG stream 105 may be greater than 5 psia, or greater than 10 psia, or greater than 15 psia, or greater than 20 psia, or greater than 25 psia. In some embodiments, the pressure of the reduced LNG stream 105 may be from about 10 psia to about 300 psia, or from about 15 psia to 200 psia. The reduced pressure LNG stream 105 is then conveyed to a first heat exchanger 121 where the reduced pressure LNG stream 105 is vaporized by heat exchange with the nitrogen gas stream 112*a*. The outlet temperature of the vaporized, reduced pressure LNG stream 107 as it leaves the heat exchanger 121 may be less than −50° C., or less than −75° C., or less than −80° C., or less than −85° C., or less than −90° C., or less than −95° C., or less than −100° C. The vaporized, reduced pressure LNG stream 107 may then be cold compressed in compressor 125 to a pressure greater than 800 psia to form compressed natural gas stream 108. The compression of the vaporized, reduced pressure LNG stream 107 may occur in a single stage or multiple stages of compression. The second LNG stream 104 is pumped in pump 126 to produce an increased pressured LNG stream 106. The pressure of the increased pressured LNG stream 106 may be a greater than 800 psia, or greater than 850 psia, or greater than 900 psia, or greater than 1000 psia. The increased pressure LNG stream 106 is then piped to a second heat exchanger 122 where the LNG stream is vaporized by heat exchange with nitrogen gas stream 112*b*. The vaporized, increased pressure LNG stream 109 may have outlet temperatures of greater than −10° C., or greater than 0° C., or greater than 10° C., or greater than 15° C., or greater than 20° C. The vaporized, increased pressurized LNG stream 109 may be combined with the compressed natural gas stream 108 to form high pressure natural gas stream 110 that is suitable for transport in the gas sales pipeline.

The high pressure LIN streams 113*a* and 113*b* exiting the heat exchangers 121 and 122 may be combined into one stream 113 and may then be further cooled in a heat exchanger 127. In some embodiments, the high pressure LIN streams 113*a* and 113*b* are each introduced individually into the heat exchanger 127, while in other embodiments, the high pressure LIN streams are combined as shown in FIG. 1 before being introduced into the heat exchanger. In some embodiments, the high pressure LIN stream 113 is sub-cooled in a flash gas heat exchanger 127 to form a sub-cooled high pressure LIN streams 114. The sub-cooled high pressure LIN stream 114 may then be let down in pressure using two-phase hydraulic turbines, single-phase hydraulic turbines, valves, or other common devices known in the art. In a preferred embodiment, the sub-cooled high pressure LIN stream 114 is let down in pressure using two-phase hydraulic turbines 128 for the last stage of pressure reduction. The reduced pressure LIN stream 115 can then be separated into a vapor component as nitrogen flash gas streams 117 and a liquid component as product LIN streams 116. The nitrogen flash gas stream 117 can then be sent back to the flash gas exchanger 127 where it can be utilized to cool the high pressure LIN stream 113 through indirect heat exchange. The warmed nitrogen flash gas streams 118 can then be cold compressed into a recycled nitrogen gas streams 119. The compression of the warmed nitrogen flash gas streams may occur in a single stage or multiple stages of compression 129. The recycled nitrogen gas stream 119 can then be mixed with the nitrogen gas streams 111 before one of the nitrogen gas streams stages of compressor 120.

Figure 2:
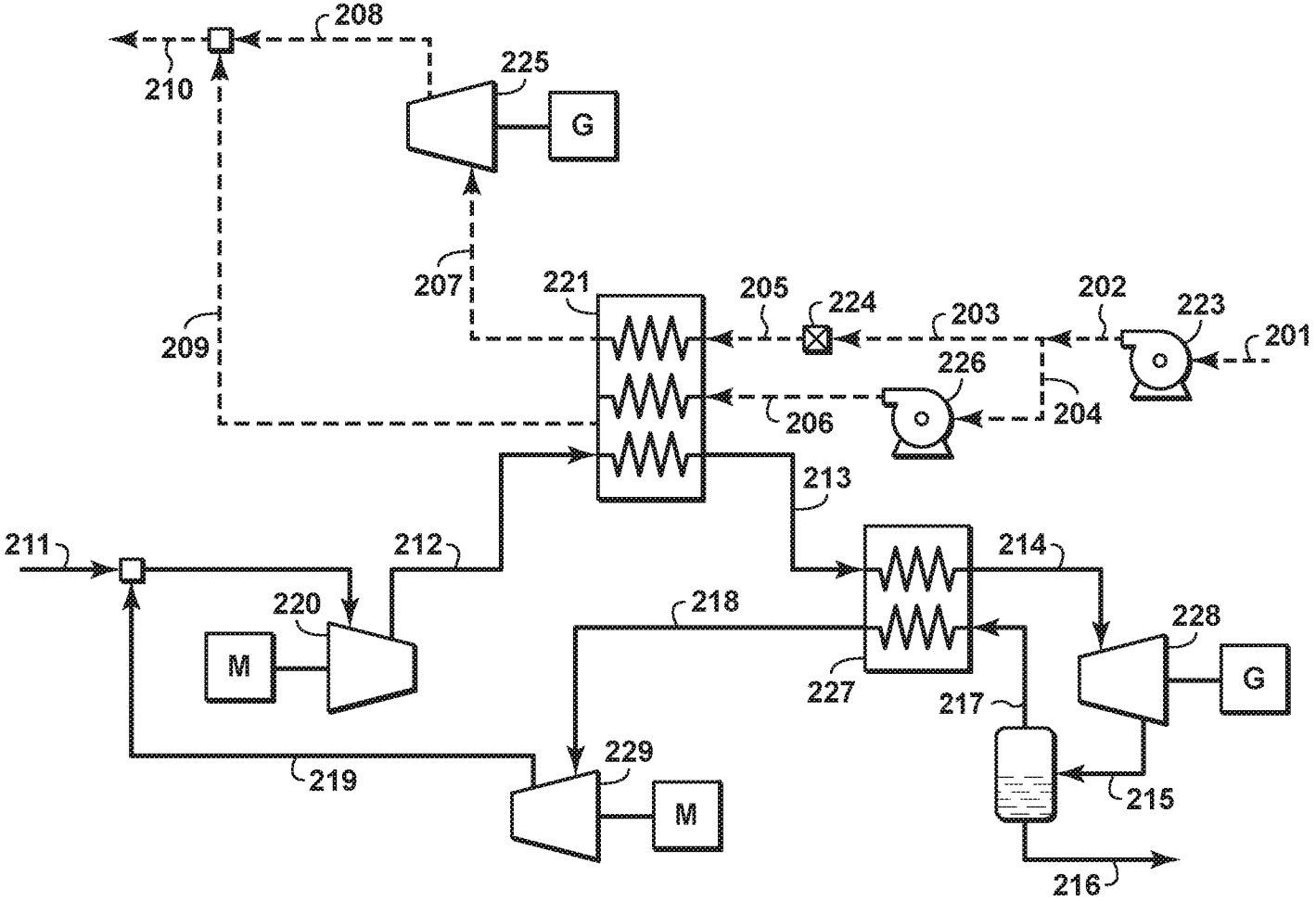
FIG. 2 illustrates a system where LIN and pressurized natural gas for pipeline transport are produced by indirect heat exchange of a nitrogen gas stream and two LNG streams at different pressures in single multi-stream heat exchanger.

FIG. 2 illustrates an embodiment where a single multi-stream heat exchanger 221 is utilized. This embodiment has the advantage that less piping is required for transporting the LNG streams and the LIN streams. Similar to the system of FIG. 1, in FIG. 2 a LNG stream 201 is introduced to the system and is pressurized 223 to an intermediate pressure. The intermediate pressure LNG stream 202 is split into a first LNG stream 203 and a second LNG stream 204. The first LNG stream 203 may be reduced in pressure by flowing through one or more valves 224 to form a reduced pressure LNG stream 205 which is then introduced to the multi-stream heat exchanger 221. The vaporized, reduced pressure LNG stream 207 that exits the multi-stream heat exchanger 221 may then be cold compressed in compressor 225 to a pressure greater than 800 psia to form compressed natural gas stream 208. The second LNG stream 204 is pumped in pump 226 to produce an increased pressured LNG stream 206 which is introduced to the multi-stream heat exchanger 221 where the LNG stream is vaporized by heat exchange with nitrogen gas stream 212. The vaporized, increased pressure LNG stream 209 exiting the multi-stream heat exchanger 221 may be combined with the compressed natural gas stream 208 to form high pressure natural gas stream 210 that is suitable for transport in the gas sales pipeline.

Like in FIG. 1, FIG. 2 also shows a nitrogen gas stream 211 entering the system and being piped to compressor 220. The compressed high pressure nitrogen gas 212 enters the multi-stream heat exchanger 221 where it is liquefied by heat exchange with the vaporizing LNG streams to form a high pressure LIN stream 213. The high pressure LIN stream 213 can then be sub-cooled in a flash gas exchanger 227 to form a sub-cooled high pressure LIN stream 214. The pressure of the sub-cooled high pressure LIN stream 214 can then be let-down, such as in a two-phase hydraulic turbine 228, to form a reduced pressure LIN stream 215. The reduced pressure LIN stream 215 can then be separated into a nitrogen flash gas stream 217 and a product LIN stream 216. The nitrogen flash gas stream 217 can then be sent back to the flash gas exchanger 227 where it can be utilized to cool the high pressure LIN stream 213 through indirect heat exchange. The warmed nitrogen flash gas streams 218 can then be cold compressed in a compressor 229 into a recycled nitrogen gas streams 219 which can then be mixed with the nitrogen gas streams 211 before one of the nitrogen gas streams stages of compression 220.

Figure 3:
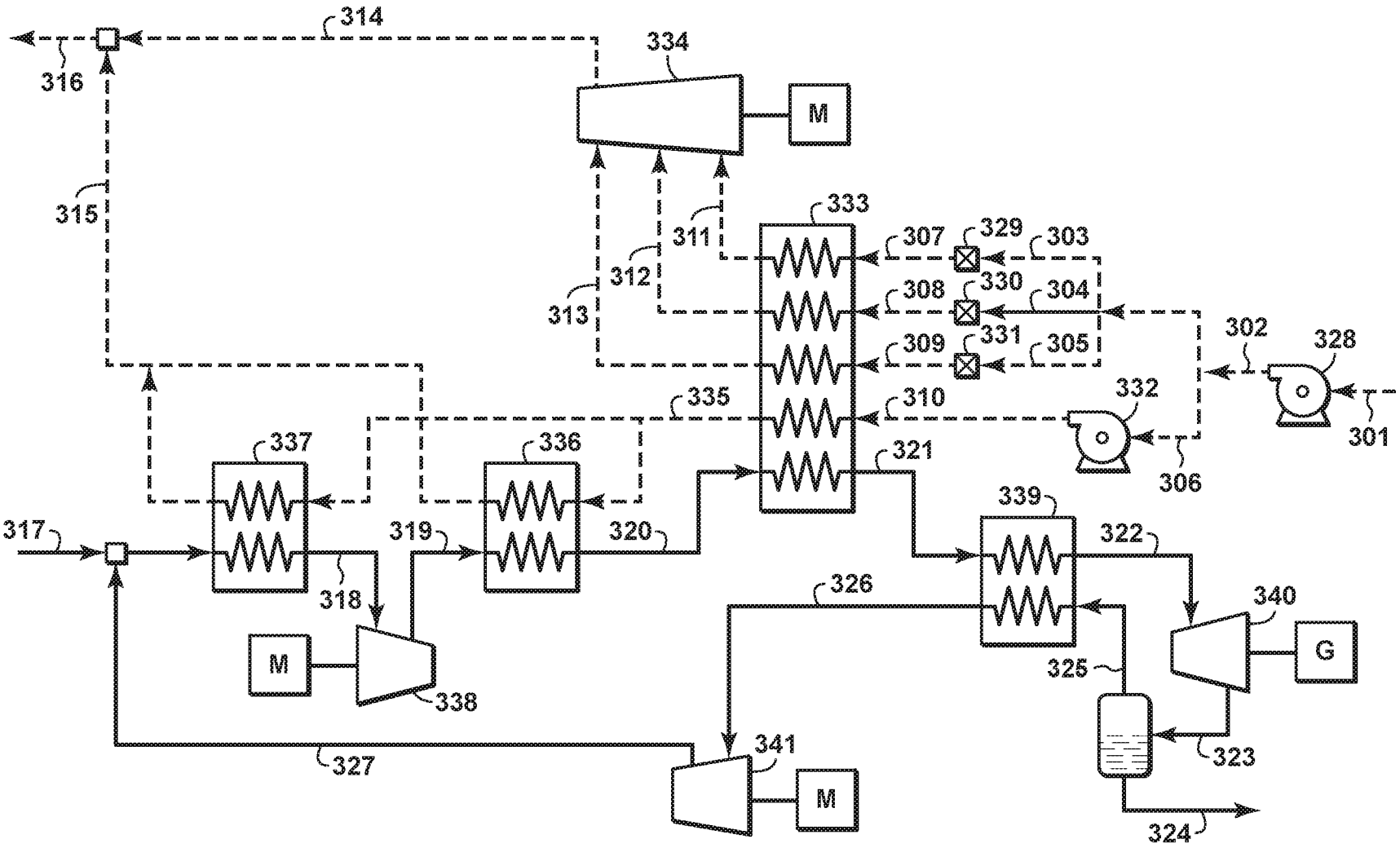
FIG. 3 illustrates a system where LIN and pressurized natural gas for pipeline transport are produced by indirect heat exchange of a nitrogen gas stream and four LNG streams at different pressures.

FIG. 3 illustrates a system where LIN and pressurized natural gas for pipeline transport are produced by indirect heat exchange of a nitrogen gas stream and four LNG streams at different pressures. A main LNG stream 301 is pressurized 328 to an intermediate pressure to form an intermediate pressure LNG stream 302. The intermediate pressure LNG stream 302 may be at a pressure of from 50 to 200 psia, or from 60 to 175 psia, or from 75 to 150 psia. The intermediate pressure LNG stream is split into four LNG streams, a first LNG stream 303, a second LNG stream 304, a third LNG stream 305, and a fourth LNG stream 306. The first, second and third LNG streams may be reduced in pressure using one or more valves 329, 330, and 331 to produce a first reduced pressure LNG stream 307, a second reduced pressure LNG stream 308, and a third reduced pressure LNG stream 309, respectively. The pressure of the first reduced pressure LNG stream 307 may be between 15 to 30 psia. The pressure of the second reduced pressure LNG stream 308 may be between 30 to 60 psia. The pressure of the third reduced pressure LNG stream 309 may be between 50 psia and the intermediate pressure. The pressures of the first, second and third reduced pressure LNG streams are independent and different from each other. The fourth LNG stream 306 is pressurized using one or more pumps 332 to a pressure that may be greater than 800 psia, or more likely, to a pressure that may be greater than 900 psia, or greater than 1000 psia, or greater than 1100 psia, or greater than 1200 psia, to form an additionally pressurized LNG stream (310). The three reduced pressure LNG streams 307, 308, and 309 and the additionally pressurized LNG stream 310 are all piped to a single, multi-stream cryogenic heat exchanger 333. Suitable cryogenic heat exchangers include, but are not limited to, brazed aluminum type heat exchangers, spiral wound type heat exchanger, and printed circuit type heat exchangers. As it is known in the art, a suitable type heat exchanger will allow for indirect heat exchange between the four LNG streams 307, 308, 309, and 310 and the nitrogen gas stream 320 while preventing or minimizing indirect heat exchange between the LNG streams. The first 307, second 308, and third 309 reduced pressure LNG streams exit the multi-stream cryogenic heat exchanger 333 as a first vaporized, reduced pressure LNG stream 311, a second vaporized, reduced pressure LNG stream 312, and a third vaporized, reduced pressure LNG stream 313, respectively. The pressure, flow rates and heat exchanger outlet temperatures of the reduced pressure LNG streams may be chosen to allow for close matching of the temperature versus heat transfer curves within the heat exchanger. It is preferred that temperatures of the vaporized, reduced pressure LNG streams be less than −50° C., or less than −60° C., or less than −70° C., or less than −80° C., or less than −90° C., less than −100° C. The vaporized, reduced pressure LNG streams may be fully or partially vaporized within the cryogenic heat exchanger. After exiting the heat exchanger 333, the vaporized, reduced pressure LNG streams may be separated into their liquid and gas components. The liquid component of the vaporized, reduced pressure LNG streams may be pumped to pressure equal to or greater than the pressures of the additionally pressurized LNG stream and then recycled back to the cryogenic heat exchanger (not shown in FIG. 3 for simplicity). The gas component of the vaporized, reduced pressure LNG streams may be pressurized in compressors 334 to a pressure suitable to introduce the compressed natural gas stream 314 to the sale gas pipeline 316 or to pressures suitable for use of the compressed natural gas stream within the regasification plant. Suitable pressures for the compressed natural gas stream may be greater than 800 psia, or greater than 900 psia, or greater than 1000 psia, or greater than 1100 psia, or may be greater than 1200 psia. In a preferred embodiment of this invention, the temperatures of the vaporized, reduced pressure LNG streams are sufficiently low so as to allow for cold compression of the gases to pressures suitable for use without requiring any intercooling of the gases during compression. It is often preferred that compressed natural gas stream be mixed with some or all the of the vaporized, additionally pressurized LNG stream 315 to form a high pressure natural gas stream 316 prior to distributing the gases to the gas sales pipeline or other users.

The additionally pressurized LNG stream 310 exits the multi-stream cryogenic heat exchanger 333 as stream 335 which may then be piped to at least one or two more heat exchangers 336 and 337 to further cool the nitrogen gas stream at the warmer end of the nitrogen gas stream cooling curve. The pressures, flow rates and heat exchanger outlet temperatures of the additionally pressurized LNG stream may be chosen to allow for close matching of the temperature versus heat transfer curves within the heat exchangers. It is preferred that the temperature of the vaporized, additionally pressurized LNG stream 315 be greater than 0° C., or greater than 10° C., or greater than 15° C., or greater than 20° C.

FIG. 3 shows a nitrogen gas stream 317 entering the system. The nitrogen gas stream may be mixed with a recycled nitrogen gas stream 327. The gas mixture, here still referred to as the nitrogen gas stream, may then be piped to at least one heat exchanger 337 where it is cooled by indirect heat exchange with all or a portion of the of the additionally pressurized LNG stream 335 to form an intercooled nitrogen gas stream 318. The additionally pressurized LNG stream may be piped to the at least one heat exchanger after flowing through the multi-stream cryogenic heat exchanger or, in some embodiments not shown, may bypass the multi-stream cryogenic heat exchanger and proceed directly to the heat exchanger. In some embodiments, the cooling of the nitrogen gas stream with the additionally pressurized LNG stream may occur before one or more of the compression stages of the nitrogen gas stream. In some embodiments, the cooling of the nitrogen gas stream with the additionally pressurized LNG streams may occur after cooling of the nitrogen gas stream with the environment. The intercooled nitrogen gas stream may have a temperature of less than 0° C., or less than −10° C., or less than −20° C., or less than −30° C., or less than −40° C., or less than −50° C. The cold compression of the intercooled nitrogen gas stream significantly reduces the energy of compression of said gas. FIG. 3 shows that the intercooled nitrogen gas stream 318 is then piped to a booster compressor 338 to form a high pressure nitrogen gas stream 319. The pressure of the high pressure nitrogen gas stream 319 is a pressure greater than 200 psia, or greater than the critical point pressure of the nitrogen gas stream, or greater than 1000 psia. The compression of the intercooled nitrogen gas stream may occur in a single stage or in multiple stages of compression. The high pressure nitrogen gas stream 319 may then be piped to at least one heat exchanger 336 where it is cooled by indirect heat exchange with all or a portion of the of the additionally pressurized LNG stream 335 to form an aftercooled nitrogen gas stream 320. In some embodiments, the cooling of the high pressure nitrogen gas stream with the additionally pressurized LNG stream may occur after cooling of the nitrogen gas stream with the environment. The aftercooled nitrogen gas stream 320 may have a temperature of less than 0° C., or less than −10° C., or less than −20° C., or less than −30° C., or less than −40° C., or less than −50° C. The aftercooled nitrogen gas stream 320 is then piped to the multi-stream cryogenic heat exchanger 333 where it is liquefied into a high pressure LIN stream 321 by heat exchange with the vaporizing LNG streams 307, 308, 309, and 310.

The LIN stream 321 shown in FIG. 3 may be further sub-cooled in a flash gas exchanger 339. The sub-cooled high pressure LIN stream 322 is let down in pressure using one or more or combinations of two-phase hydraulic turbines, single-phase hydraulic turbines, valves, or other common devices known in the art, said turbines valves being represented in FIG. 3 as a turbine 340. In a preferred embodiment of this invention, the sub-cooled high pressure LIN stream is let down in pressure using a two-phase hydraulic turbine for its last stage of pressure reduction. The reduced pressure LIN stream 323 is then separated into its vapor component as nitrogen flash gas stream 325 and its liquid component as product LIN stream 324. The nitrogen flash gas stream is sent to the flash gas exchanger 339 where it acts to cool the high pressure LIN stream 321 through indirect heat exchange. The warmed nitrogen flash gas stream 326 is then cold compressed, using a compressor 341, into a recycled nitrogen gas stream 327. The compression of the warmed nitrogen flash gas stream may occur in a single stage or multiple stages of compression. The recycled nitrogen gas stream 327 is then mixed with the nitrogen gas stream 317 before one of the nitrogen gas stream stages of compression.

Example

Figure 4:
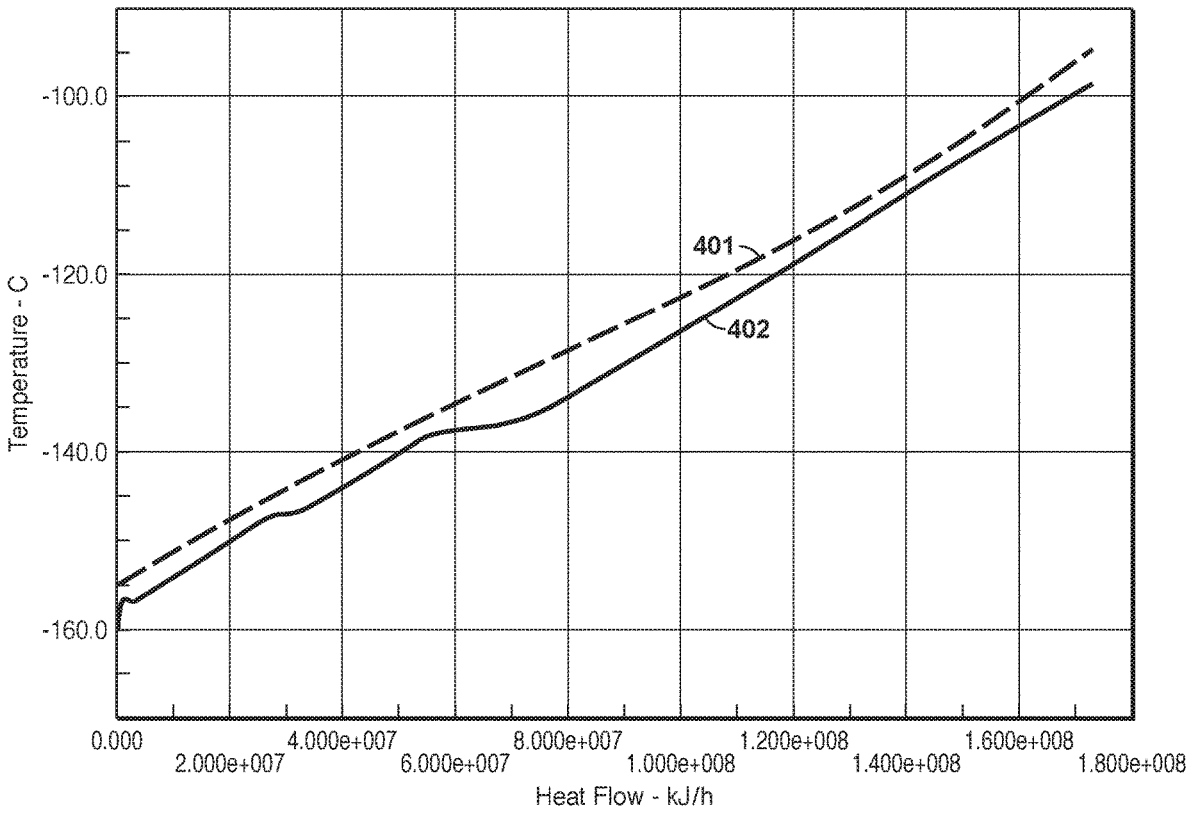
FIG. 4 shows a model of a cooling curve for a nitrogen gas stream and a composite warming curve of four LNG streams that utilized the system in FIG. 3.

A simulation was conducted to model the cooling curves exhibited by the nitrogen gas stream and LNG streams of a system configured as in FIG. 3. FIG. 4 shows the cooling curve for a nitrogen gas stream 401 along with a composite warming curve of four LNG streams 402 that utilize the system in FIG. 3. In the simulation, the nitrogen gas stream 315 enters the multi-stream heat exchanger 333 at a pressure of 1295 psia. The first reduced pressure LNG stream 307 enters the heat exchanger at a pressure of 22.4 psia and exits 311 the heat exchanger at a temperature of −118° C. The second reduced pressure LNG stream 308 enters the heat exchanger at a pressure of 42.5 psia and exits 312 the heat exchanger at a temperature of −118° C. The third reduced pressure LNG stream 309 enters the heat exchanger at a pressure of 74 psia and exits 313 the heat exchanger at a temperature of −118° C. The additionally pressurized LNG stream 310 enters the heat exchanger at a pressure 1230 psi and exits 335 the heat exchanger at a temperature of −98.5° C. The first, second and third reduced pressure LNG streams accounts for 0.93%, 1.9% and 5.23% of the total LNG flow, respectively. The additionally pressurized LNG stream accounts for the remaining balance (91.94%) of the LNG flow. For this example, the heat exchanger was designed for a minimum approach temperature of 2° C. It had a log mean temperature difference of 2.884° C. for a heat duty of 48.1 MW. As seen in FIG. 4, by varying the pressure and amount of LNG in each stream, the composite warming curve of the four LNG streams are able to approximate the cooling curve of the nitrogen gas stream. This allows for efficient use of the exergy of the system when forming the LIN and the regasification of the LNG.

Certain embodiments and features have been described using a set of numerical upper limits and a set of numerical lower limits. It should be appreciated that ranges from any lower limit to any upper limit are contemplated unless otherwise indicated. All numerical values are "about" or "approximately" the indicated value, and take into account experimental error and variations that would be expected by a person having ordinary skill in the art.

All patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

We claim:

1. A method for producing a liquefied nitrogen (LIN) stream at a liquid natural gas (LNG) regasification facility comprising:

(a) providing a nitrogen gas stream;

(b) providing a liquefied natural gas (LNG) stream;

(c) splitting the LNG stream into at least a first, second, third, and fourth LNG streams;

(d) reducing the pressure of the first, second, and third LNG streams such that the pressure of the first LNG stream is from 10 psia to 35 psia, the pressure of the second LNG stream is from 30 to 60 psia, and the pressure of the third LNG stream is from 50 to 100 psia;

(e) liquefying the nitrogen gas stream to form a liquefied nitrogen stream by indirect heat exchange of the nitrogen gas stream with the first, second, third, and fourth LNG streams;

(f) vaporizing at least a portion of the first, second, third, and fourth LNG streams, to form a first, second, third, and fourth natural gas streams;

(g) compressing at least one of the first, second, third, or fourth natural gas streams to form a compressed natural gas stream.

2. The method of claim 1, where the LNG stream provided in step (b) is provided at a pressure of from 14 psia to 25 psia.

3. The method of claim 1, further comprising pressurizing the LNG stream of step (b) to a pressure of from 50 psia to 200 psia before step (c).

4. The method of claim 1, further comprising increasing the pressure of the fourth LNG stream of step (c) to a pressure greater than 800 psia.

5. The method of claim 1, wherein the pressure of the nitrogen gas stream introduced to the heat exchanger in step (e) is at a pressure greater than 1000 psia.

6. The method of claim 1, wherein the temperature of the first, second, and third natural gas streams at the outlet of the heat exchanger is from −120° C. to −75° C.

7. The method of claim 1, wherein the temperature of the fourth natural gas stream at the outlet of the heat exchanger is from −80° C. to −100° C.

8. The method of claim 1, wherein the first LNG stream comprises less than 5% of the LNG stream.

9. The method of claim 1, wherein the second LNG stream comprises less than 7% of the LNG stream.

10. The method of claim 1, wherein the third LNG stream comprises less than 10% of the LNG stream.

* * * * *